United States Patent [19]

Sessa

[11] 4,110,935

[45] Sep. 5, 1978

[54] CABLE-ACTUATED, CAR-SIDE-WINDOW-LIFTING MECHANISM

[76] Inventor: Terenzio Sessa, Via Albani 5, Varese, Italy

[21] Appl. No.: 848,880

[22] Filed: Nov. 7, 1977

[30] Foreign Application Priority Data

Nov. 10, 1976 [IT] Italy ..... 29190 A/76

[51] Int. Cl.[2] ..... E05F 11/48

[52] U.S. Cl. ..... 49/352

[58] Field of Search ..... 49/352, 123, 115; 254/175.3

[56] References Cited

U.S. PATENT DOCUMENTS

| | | | |
|---|---|---|---|
| 2,432,799 | 12/1947 | Rappl | 49/352 X |
| 4,026,071 | 5/1977 | Sessa | 49/352 |

FOREIGN PATENT DOCUMENTS

| | | | |
|---|---|---|---|
| 213,247 | 6/1960 | Austria | 49/352 |
| 491,917 | 4/1953 | Canada | 49/352 |
| 588,041 | 1/1925 | France | 49/352 |
| 2,323,784 | 11/1974 | Fed. Rep. of Germany | 49/352 |

*Primary Examiner*—Philip C. Kannan

*Attorney, Agent, or Firm*—Shlesinger, Fitzsimmons & Shlesinger

[57] ABSTRACT

An improvement in the car-side-window mechanisms of the cable-actuated type is disclosed, in which a device is provided which allows for the tension differentials which may occur in the actuating cable sections due to the uneven abutment of the window glass top edge against the window frame. The device is a takeup mechanism composed by an arcuate spring the ends of which coact with two swingable plates, each of which carries a follower. The plates under the bias of the spring can be approached to one another or diverge from one another and thus make up the tension differential in the two confronting cable sections, as transferred to such plates by the respective followers.

4 Claims, 4 Drawing Figures

Fig. 3
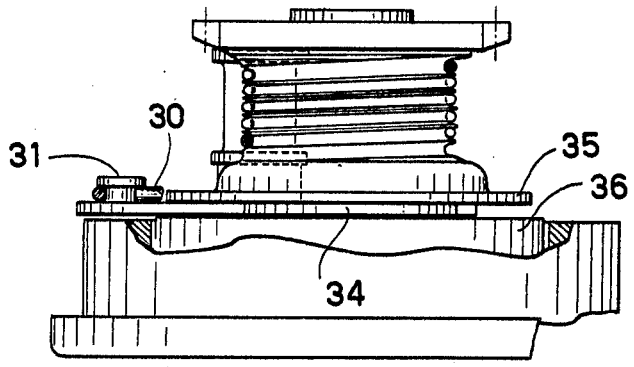
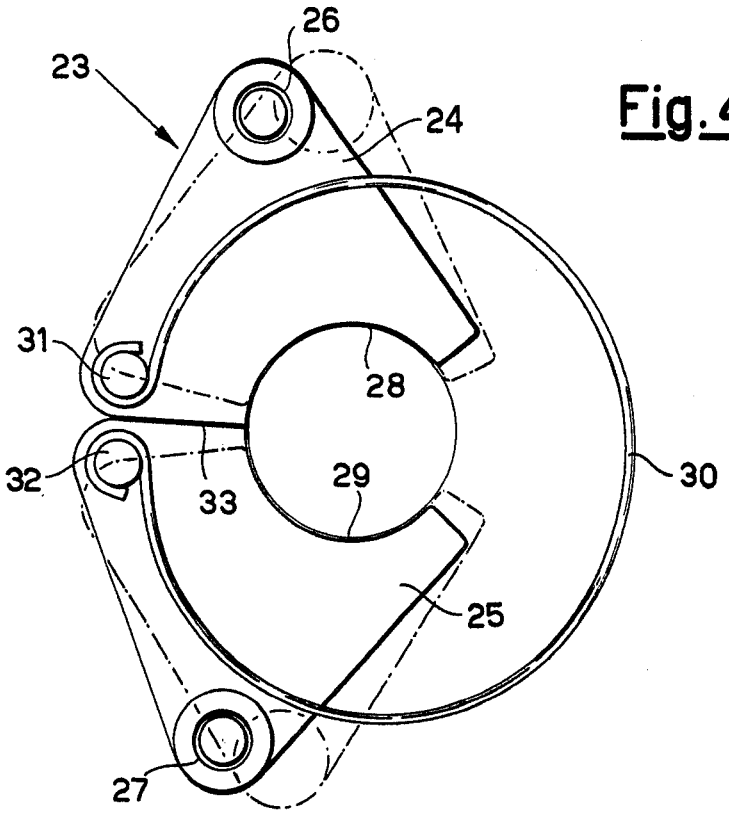
Fig. 4

CABLE-ACTUATED, CAR-SIDE-WINDOW-LIFTING MECHANISM

This invention relates to a significant improvement introduced in a car-side-window lifting mechanism of the so-called cable- or wire-actuated type, which is employed, more particularly in the motor car field.

As is well known to all those skilled in the art, in the cable-actuated car window lifting mechanisms for motor cars, the lifting and depressional movements of the glass of the window are entrusted to the manipulation of a pulley about which a wire is wound and unwound, which is fastened by stirrup-like stops to the glass bottom edge.

More detailedly, from the pulley on which a certain length of cable is wound, there start, in the tangential direction, two cable laps which, by being wrapped on a closed loop on idle pulleys, define one or two vertical branches to which the window glass to be displaced are fastened.

In the closing stage of the window, the stop of the rotation of the pulley, be it controlled manually by a handle or automatically by an electric motor, takes place when the glass plate abuts the window frame.

Inasmuch as it is virtually impossible that each and every point of the top edge of the glass plate may simultaneously abut the window frame, in the cable sections which tangentially emerge from the drive pulley, excessive pulls or, conversely, slackenings may occur which might be conducive to an ejection of the cable from the drive pulley or from any of the idle pulleys.

An object of this invention is just to overcome this defect and, to this purpose, it has been thought to provide a cable-actuated, or wire-actuated glass lifting mechanism in which the lifting and depressional motion of the glass of a car window are obtained through the rotation of a pulley around which two cable sections are wound and unwound, which are fastened to the bottom edge of the glass plate, said mechanism being characterized in that, in combination with said drive pulley, two confrontingly mounted idlers are provided, about which said two cable sections are partially wound, said two idlers being mounted for rotation, by the intermediary of supporting means, about the axis of the driving pulley, freely in unison, and separately, against the bias of counteracting means.

The structural and functional features of the invention along with its advantages will become still more conspicuous from the scrutiny of the ensuing exemplary description aided by the accompanying drawings.

In the drawings:

FIG. 3 is a partially cross-sectional elevational view showing the drive pulley of the glass-lifting mechanism on which the automatic device of this invention has been installed for the takeup of the correct tension of the cable, and FIG. 4 is a plan view of the device concerned.

Figure 1:
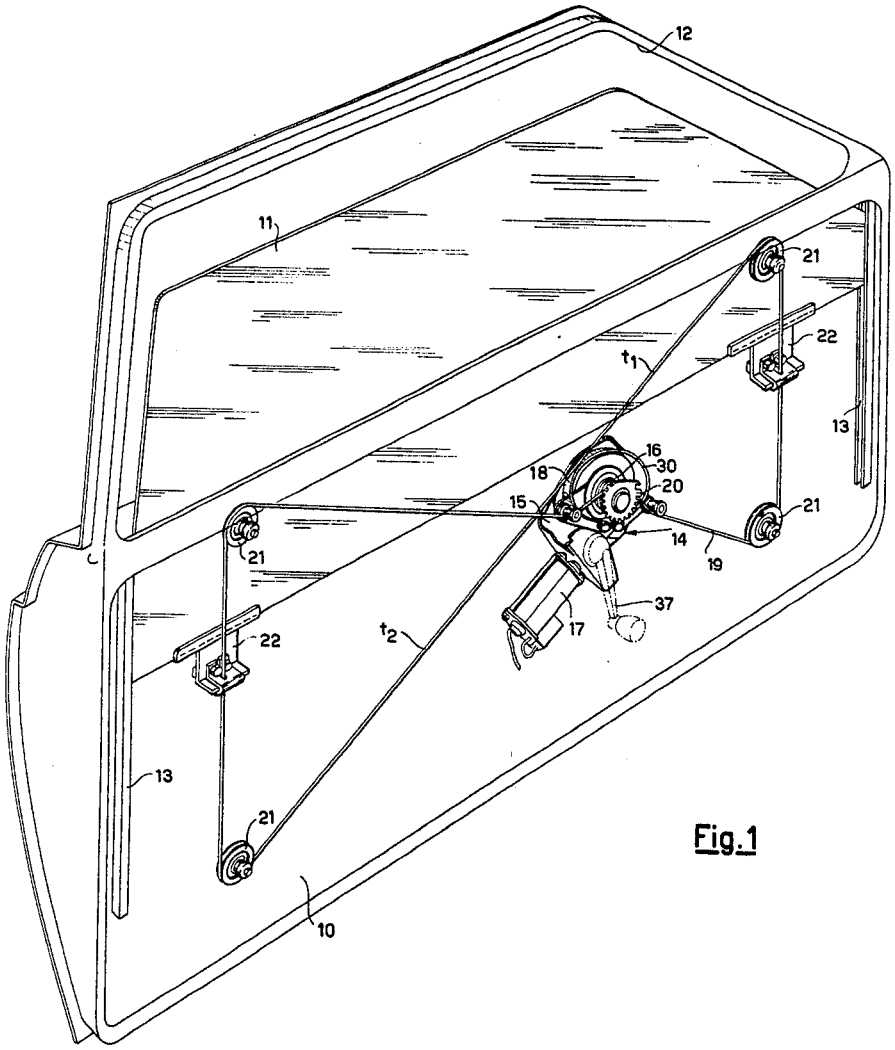
FIG. 1 is a perspective view which shows a car door equipped with a glass-lifting mechanism according to this invention.

Having now reference, at the outset, to FIG. 1 of the accompanying drawings, on a side door 10 of a motorcar, the glass plate 11 of a window 12 can be driven vertically to slide within side guideways 13 by the agency of a cable-actuated glass-lifting mechanism generally indicated at 14.

The glass-lifting mechanism shown is of the kind disclosed in the Italian Patent Specification No. 927030, in the U.S. Pat. No. 4.026.071 and in the German Patent Application No. P 2719617.4 all in the name of the same Applicant hereof.

This notwithstanding, the improvement the subject of the present invention is likewise applicable to cable-actuated glass-lifting mechanisms of a kind other than that disclosed in the abovementioned patent documents, to which reference is invited for any further clarifications which may become necessary as to the structure of the glass-lifting mechanism shown herein by way of example only.

The glass-lifting mechanism comprises a plate 15 carrying a pulley 16 driven to rotation by an electric motor 17 through a reducing gearbox 18.

To the pulley 16, to which an end of the cable 19 is fastened, there is connected, by a one-way front-dog clutch, a wheel 20, which is partially crenellated and is intended for tensioning the cable 19 as the mechanism is installed, as has clearly been disclosed and explained in the Italian Pat. No. 927 030 and The wheel 20 is coaxial with the pulley 16, the other end of the cable 19 being fastened to said wheel.

About the pulley 16 is wound a certain length of the cable, the latter leaving the pulley with two tangential sections which are wound, in a closed loop, about idle pulleys 21, the latter being mounted on the door 10.

The route of the cable 19 is such as to define two vertical side sections to which is fastened, by means of jaws 22, the bottom edge of the glass plate 11.

Coaxially with the pulley 16 is mounted the device of the invention which is generally indicated at 23 in FIG. 4.

The device 23 is structurally composed by two plates 24, 25 carrying respective idle rollers 26, 27 in opposite end positions. Two confronting sides of the plates 24, 25 are shaped as arcs of circumference 28, 29 having the same radius. A wire spring 30, having its ends fastened at 31 and 32 to the plates 24 and 25, respectively, tends to keep such plates in the position shown in FIG. 4, that is, with the side 33 in common.

Figure 2:
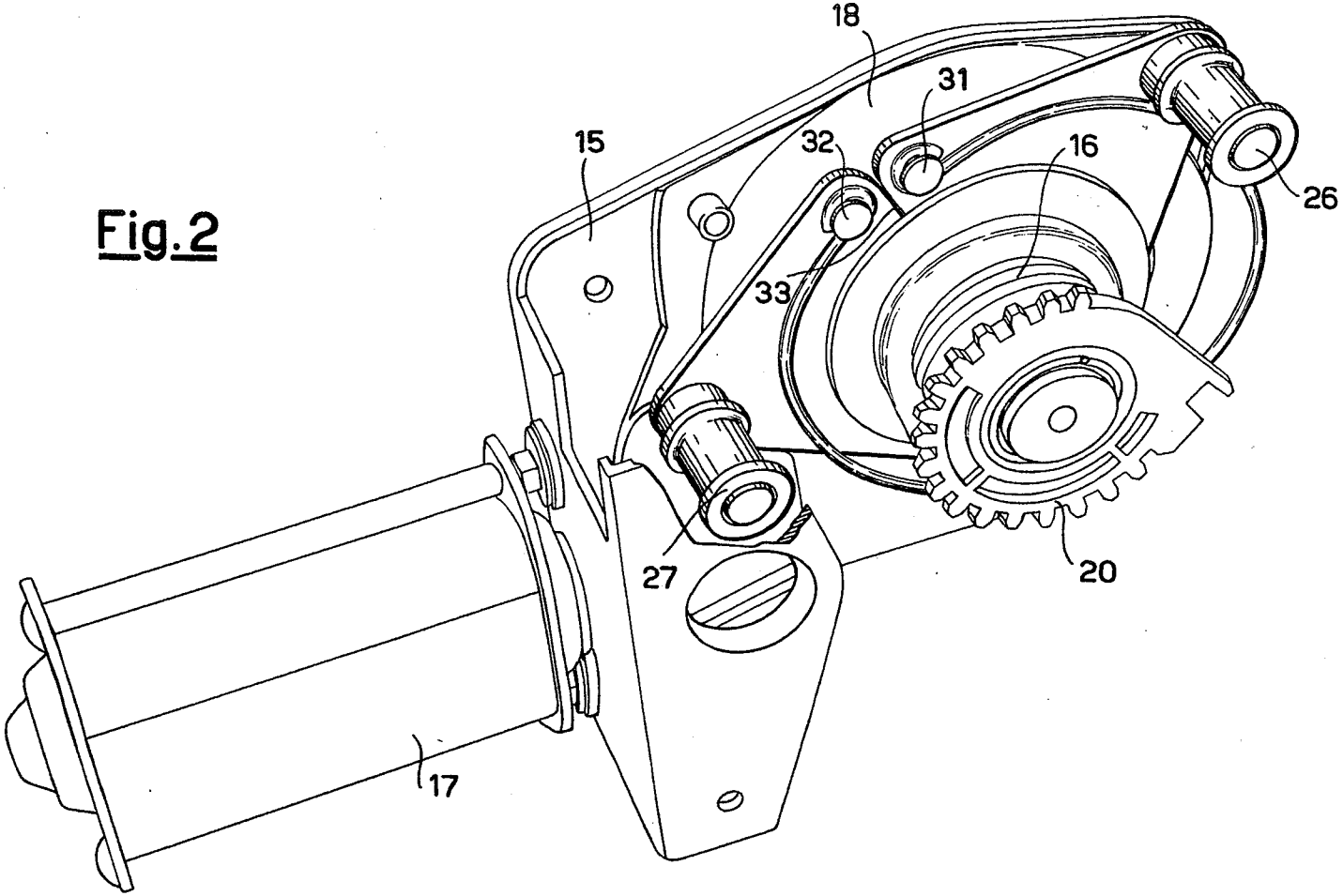
FIG. 2 is a closeup perspective view of the glass-lifting mechanism of FIG. 1.

The device 23 is applied to the glass-lifting mechanism 14 in the manner which is clearly shown in FIGS. 1, 2 and 3 of the drawings, that is with the portions of circumference 28, 29 which encompass a hub 34 between a flange 35 to which the pulley is affixed and a wall portion 36 of the gear of the reducing box 18, said hub 34 being coaxial with the axis of rotation of the pulley.

The plates 24, 25 are thus freely rotatable about the hub 34 so as to be able to place the idlers 26, 27 in the position which is the most suitable for guiding the sections $t_1$ and $t_2$ of the cable 19 tangentially of the pulley 16.

For example, as the glass plate 11 is in the closed position, inasmuch as its top edge does not simultaneously abut at each and every point of the window frame, an excess tension is experienced in either section $t_1$ or $t_2$ of the cable, whereas the other portion, as it is obvious, is slackened. This fact occurs because the motor 17 continues to rotate the pulley 16 until reaching a complete closure of the window, that which corresponds to a preselected load beyond which the motor is automatically stopped.

The excess tension of the section $t_1$ or $t_2$ as the case may be, is discharged onto the relative idler 26 (or 27) which, against the bias of the spring 30, will rotate about the hub 34, thus driving to rotation also the other roller, the latter automatically restoring the correct tension in the slackened cable section.

Thus, possible ejections of the cable from the idlers 21 or the drive pulley itself are effectively prevented.

The same is true if the drive pulley 16 is manipulated by a handle 37 rather than by the motor 17.

While there has been described and illustrated a possible embodiment of the invention, it will be understood that modifications and changes can be introduced therein without thereby departing from the scope of the invention as defined in and by the appended claims.

I claim:

1. A cable-actuated car-side-window lifting mechanism in which the lifting or depressional motion of the window glass plate is carried out by the rotation of a pulley around which there are wound and unwound two portions of the cable fastened to the bottom edge of the plate glass, characterized in that, in combination with said pulley two idle rollers are provided which are confrontingly mounted and about which said two cable sections are partially wound, said two rollers being mounted by the agency of supporting members for being rotated about the axis of the pulley in unison freely and discretly against the bias of counteracting means.

2. A glass-lifting mechanism according to claim 1, characterized in that said supporting means for the rollers are two plates which exhibit two portions of circumference having the same radius and which are adapted to encompass a hub external to the driving pulley between two confining shoulders.

3. A glass-lifting mechanism according to claim 2, characterized in that said counteracting means comprise a wire spring the ends of which are respectively fastened to said plates.

4. A glass-lifting mechanism according to claim 2, characterized in that said two confining shoulders are respectively formed by a flange carrying the pulley and by a portion of the gear of the reducing gearbox of an electric motor intended to actuate the lifting mechanism.

* * * * *